US006105990A

United States Patent [19]

Sutherland

[11] Patent Number: 6,105,990

[45] Date of Patent: Aug. 22, 2000

[54] SYSTEM FOR MOUNTING CLIMBING FABRIC TO A SKI

[76] Inventor: Robert L. Sutherland, 714 Earl Grey Crescent SW., Calgary, Alberta, Canada, T2S 0N7

[21] Appl. No.: 09/018,610

[22] Filed: Feb. 4, 1998

[51] Int. Cl.[7] ..... A63C 5/035

[52] U.S. Cl. ..... 280/604; 280/809

[58] Field of Search ..... 280/604, 605, 280/608, 609, 615, 809, 816

[56] References Cited

U.S. PATENT DOCUMENTS

| | | | |
|---|---|---|---|
| 2,326,802 | 8/1943 | Robinson et al. | 280/604 |
| 4,095,813 | 6/1978 | Hall | 280/604 |
| 4,116,463 | 9/1978 | Zoor | 280/615 |
| 4,666,178 | 5/1987 | Matthews | 280/604 |
| 5,052,708 | 10/1991 | Matthews | 280/604 |

FOREIGN PATENT DOCUMENTS

| | | | |
|---|---|---|---|
| 157997 | 2/1940 | Austria | 280/604 |
| 163089 | 5/1949 | Austria | 280/604 |
| 214824 | 4/1961 | Austria | 280/604 |
| 385974 | 1/1940 | Canada . | |
| 489340 | 1/1953 | Canada . | |
| 736902 | 12/1932 | France . | |
| 810162 | 3/1937 | France . | |
| 851870 | 1/1940 | France | 280/604 |
| 924496 | 3/1955 | Germany | 280/604 |
| 50972 | 2/1910 | Switzerland . | |
| 62154 | 7/1913 | Switzerland . | |
| 84074 | 4/1919 | Switzerland . | |
| 154216 | 4/1932 | Switzerland | 280/604 |
| 164229 | 12/1933 | Switzerland | 280/604 |
| 186000 | 8/1936 | Switzerland | 280/604 |
| 314947 | 7/1956 | Switzerland | 280/604 |
| 395832 | 1/1966 | Switzerland | 280/604 |
| 408735 | 9/1966 | Switzerland | 280/604 |

*Primary Examiner*—J. J. Swann
*Assistant Examiner*—F. B. Vanaman
*Attorney, Agent, or Firm*—Pearne & Gordon LLP

[57] ABSTRACT

A system for mounting climbing fabric to a ski is described. A climbing fabric tensioner is attached to the front end of the climbing fabric by a tensioning cord. The climbing fabric tensioner is retained by a bracket attached to a top surface of a toe of the ski. A heel lock is attached to a rear end of the climbing fabric. The heel lock engages a boss in a top surface of the heel of the ski to lock the rear end of the climbing fabric to the ski. At least one Z-shaped bracket is attached to the underside of the climbing fabric between the heel lock and the climbing fabric tensioner. The Z-shaped brackets have upturned and inturned ends which engage opposite sides of the ski when the climbing fabric is mounted on the ski, to prevent the climbing fabric from sliding laterally from under the ski. The advantage is a light-weight system for mounting climbing fabric to skis which permits mounting to be accomplished in seconds and provides a secure mounting which prevents the climbing fabric from sliding from under the skis. A further advantage is that the system folds into a very small, light-weight bundle which can be stored in a pocket when not in use.

15 Claims, 2 Drawing Sheets

SYSTEM FOR MOUNTING CLIMBING FABRIC TO A SKI

FIELD OF THE INVENTION

This invention relates generally to cross-country ski equipment and, in particular, to attachments for hill climbing on skis.

BACKGROUND OF THE INVENTION

Snow skis are one of the oldest forms of personal transportation in winter conditions. Snow skis are favoured as a mode of personal transportation because they permit forward locomotion on downhill inclines with limited exertion. Climbing in skis can, however, be a very laborious process. Much ingenuity has been invested in developing ways to permit climbing while maintaining the ability to glide on a downhill slope. Waxes have been developed for that purpose but waxes generally have a very limited operational temperature range.

It was long ago observed that certain sea mammals have the ability to slither up snow covered slopes and slide down the slopes with great efficiency. Strips of the hide of those mammals were attached to the underside of skis to permit a skier to climb hills and glide downhill slopes. It was soon discovered, however, that keeping those "climbing skins" attached to the skis was a significant challenge. Many systems have subsequently been developed for attaching climbing skins to skis. All known systems have certain disadvantages. Some are difficult to mount or dismount. Others are bulky to transport. Some interfere with normal ski response. And, some permit the climbing skin to slide laterally from under the ski when traverses on steep slopes are attempted.

Climbing skins have now been replaced by woven fabrics with a slant pile hereinafter referred to as "climbing fabric". Climbing fabrics are commonly treated with a latex or plastic sealant to keep them dry in wet snow conditions. Such climbing fabrics are used for both recreational and military applications. They are particularly useful for wilderness skiing in mountainous regions where slopes are too steep for practical use of waxes and/or large temperature fluctuations due to rapid changes of elevation prohibit efficient use of wax. They are also favoured for military applications where sure footing is at least as important as quick movement over the snow.

As noted above, a significant disadvantage of prior art systems has been their ease of use and/or their bulk. For wilderness skiing it is important to have a system for mounting climbing fabric which is quickly and easily installed or removed from the ski. This permits the climbing fabric to be used during uphill treks and removed for extended downhill glides, even while skiing in very cold or inclement weather. Likewise, it is important to provide a system for mounting climbing fabric which folds easily into a small, light-weight bundle when not in use to permit a skier to transport the system in a pocket or a small pack. This permits the skier to use the climbing fabric for ascending slopes and to remove it for long downhill glides.

There therefore still exists a need for a light-weight secure system for mounting climbing fabric to a ski.

SUMMARY OF THE INVENTION

It is an object of the invention to provide a light-weight system for mounting climbing fabric to a ski which is quickly and easily mounted to the ski for uphill climbs and removed from the ski for extended downhill glides.

It is a further object of the invention to provide a system for mounting climbing fabric to a ski which folds into a small, light-weight bundle that can be easily carried by a person when not in use.

It is a further object of the invention to provide a system for mounting climbing fabric to a ski which securely retains the fabric on the sole of the ski without lateral displacement during climbing or traversing slopes.

The invention provides a system for mounting climbing fabric to a ski, the climbing fabric having a front end and a rear end, an outer side for engaging snow and an underside for contacting the ski, the climbing fabric being shaped to permit the ski to glide in a forward direction but resist movement in a rearward direction when the outer side is placed on a snow covered surface, comprising in combination:

- a climbing fabric tensioner attached to the front end of the climbing fabric by a tensioning cord, the climbing fabric tensioner being adapted to be retained by a bracket attached to a toe of the ski;
- a heel lock attached to a rear end of the climbing fabric, the heel lock engaging a boss in a top surface of a heel of the ski to lock the rear end of the climbing fabric to the heel of the ski; and
- at least one z-shaped bracket attached to the underside of the climbing fabric between the heel lock and the climbing fabric tensioner, the at least one z-shaped bracket having upturned and inturned ends which engage opposite sides of the ski when the climbing fabric is mounted thereto to prevent the climbing fabric from sliding laterally from under the ski.

The system in accordance with the invention for mounting climbing fabric to a ski therefore includes the heel lock that engages a boss mounted to a top surface of a heel of the ski and the climbing fabric tensioner which is levered over the toe of the ski and engages a bracket to tension the climbing fabric over the length of the ski. Lateral displacement of the climbing fabric is prevented by at least one Z-shaped bracket that engages opposite side edges of the ski. The Z-shaped brackets prevent the climbing fabric from being laterally displaced from under the ski when traversing slopes.

This system is light-weight and may be rolled into a small bundle that readily fits in a pocket or a small pack. Even though the system in accordance with the invention is light-weight and folds into a small bundle, the system provides a secure attachment of a climbing fabric which keeps the climbing fabric on the ski even while climbing steep slopes.

BRIEF DESCRIPTION OF THE DRAWINGS

The invention will now be further explained by way of example only, and with reference to the following drawings, wherein.

DETAILED DESCRIPTION OF THE PREFERRED EMBODIMENT

Figure 1:
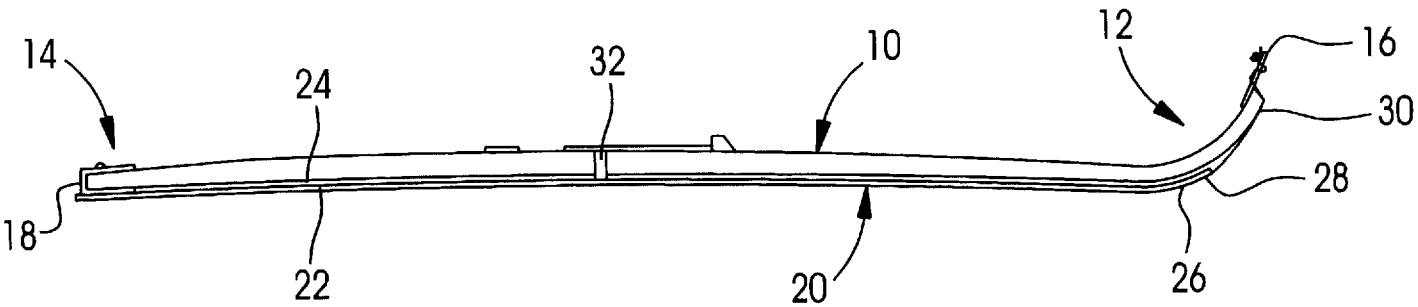
FIG. 1 is a side elevational view of a ski equipped with a system for mounting climbing fabric in accordance with the invention.

FIG. 1 shows a side elevational view of a ski 10 equipped with a system for mounting climbing fabric in accordance with the invention. The ski 10 has a toe 12 and a heel 14. The system in accordance with the invention includes a climbing fabric tensioner 16 and a heel lock 18 which will be described below in more detail. Stretched between the climbing fabric tensioner 16 and heel lock 18 is a climbing fabric 20, which is commonly a slant pile woven fabric well known in the art and available from a plurality of manufacturers. The climbing fabric 20 has an outer side 22 with rearwardly oriented fibres that permit the ski to glide forwardly but inhibit rearward movement in a manner well known in the art. The climbing fabric 20 also has an underside 24 which lies against a bottom surface of the ski. As is well known in the art, the climbing fabric 20 is supplied in strips having a width approximately equal to the width of the ski 10 and a length which extends from the heel 14 of the ski to at least part way up the curve at the toe 12 of the ski 10.

Affixed to a front end of the climbing fabric 20 is a tensioning plate 26. Adjacent to the front edge of the tensioning plate 26 are a pair of holes 29 (FIG. 4*c*) through which a tensioning cord 30 is threaded. The tensioning cord 30 is attached to the climbing fabric tensioner 16 as will be explained below with reference to FIGS. 4*a*–4*c*. Mounted to a centre of the ski is a Z-shaped bracket 32 which inhibits lateral displacement of the climbing fabric 20 from under the ski 10. For short skis, only one Z-shaped bracket 32 is required. For longer skis, two or more Z-shaped brackets 32 may be mounted to the underside of the climbing fabric 20.

Figure 2C:
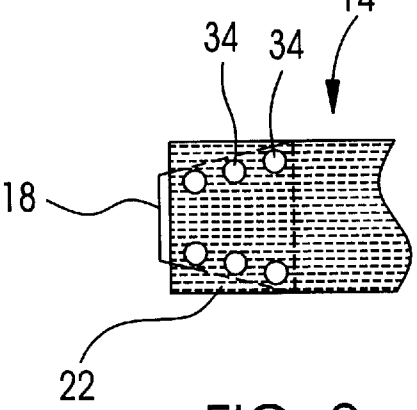
FIGS. 2*a*–2*c* are respectively a side elevational view, a top plan view and a bottom plan view of a heel portion of the ski shown in FIG. 1, illustrating the heel lock used to lock the rear end of the climbing fabric to the ski.
Figure 2B:
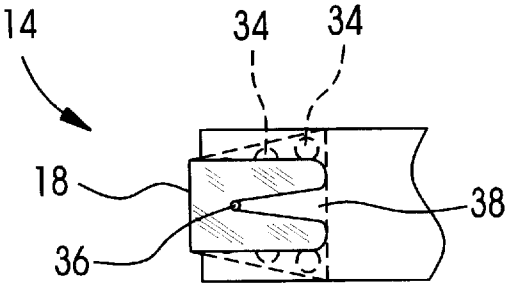
Figure 2A:
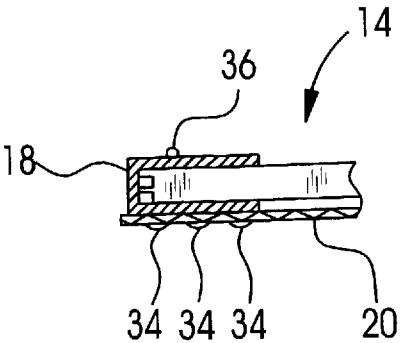
Figure 3C:
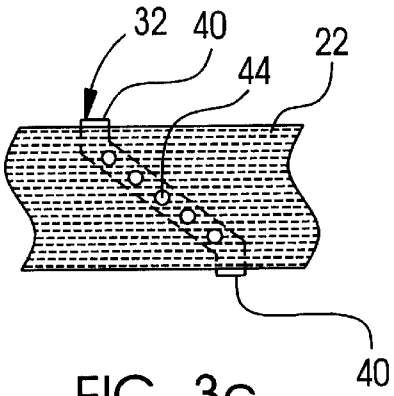
FIGS. 3*a*–3*c* are respectively a side elevational view, a top plan view and a bottom plan view of a centre portion of the ski shown in FIG. 1, illustrating the Z-shaped bracket used for preventing lateral displacement of a climbing fabric attached to the ski.

FIGS. 2*a*–2*c* show enlarged views of a portion of the heel 14 of the ski 10. The heel lock 18 is generally U-shaped in side view and is slid forwardly over the heel 14 of the ski 10. It is attached to the climbing fabric 20 by a plurality of rivets 34. It is locked against lateral displacement by the boss 36, which is preferably a pin secured to a top surface of the heel 14 of the ski 10. As shown in FIG. 2*b*, the heel lock 18 preferably includes a U-shaped throat 38 which receives the boss 36 to prevent lateral displacement of the heel lock 18 from the ski. As shown in FIG. 3*c*, the heel lock 18 is preferably mounted to the underside 24 of the climbing fabric 20 so that drag is minimized. The heel lock 18 is preferably made from a sheet metal stock of aluminum alloy. A sheet metal of about 0.0757" (1.92 mm) in thickness is preferred.

Figure 3B:
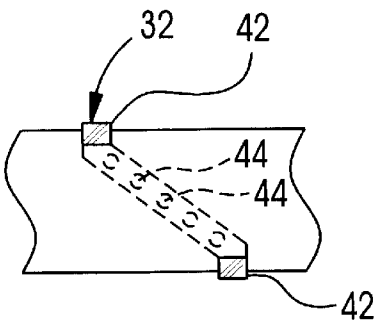
Figure 3A:
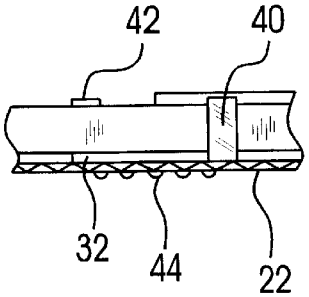

FIGS. 3*a*–3*c* illustrate the shape and construction of the Z-shaped brackets 32. Each Z-shaped bracket has upturned sides 40 and inturned ends 42. The upturned sides 40 have a length which permits the inturned ends 42 to extend over a top surface of the ski without marring the ski. Each Z-shaped bracket is attached to an underside 24 of the climbing fabric 20 by a plurality of rivets 44, for example. The Z-shaped bracket 32 is also preferably made from sheet metal stock of aluminum alloy. A sheet metal of about 0.0757" (1.92 mm) in thickness is preferred.

Figure 4C:
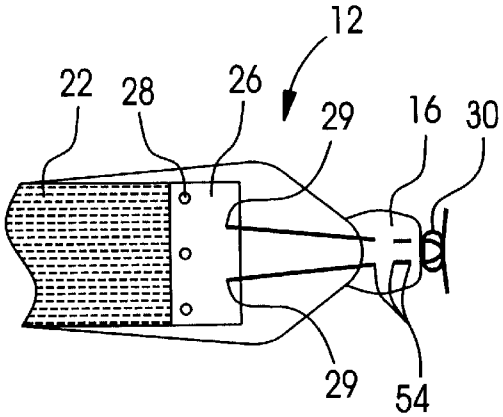
FIGS. 4*a*–4*c* are respectively a side elevational view, a top plan view and a bottom plan view of a toe portion of the ski shown in FIG. 1, illustrating the climbing fabric tensioner and the bracket for retaining the climbing fabric tensioner.
Figure 4B:
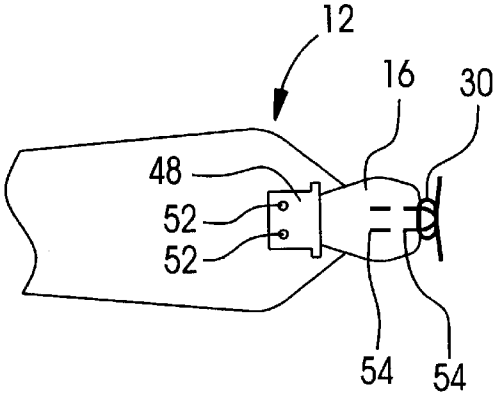
Figure 4A:
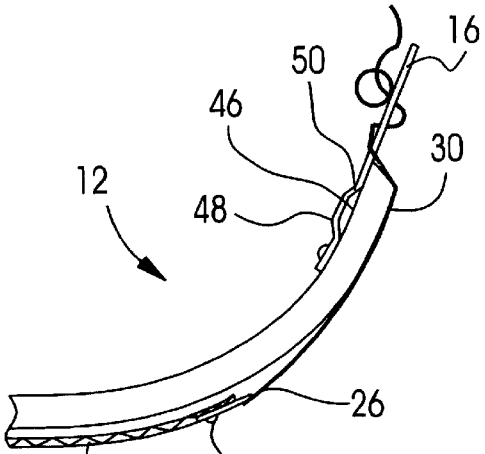

FIGS. 4*a*–4*c* show the construction and use of the climbing fabric tensioner 16. The climbing fabric tensioner 16 is preferably a flat plate which is substantially oval in shape. When the climbing fabric 20 is mounted to the ski, the heel lock 18 is slid over the heel of the ski and the climbing fabric tensioner 16 is levered over the toe of the ski and inserted into a slot 46 formed by a bracket 48 attached to the toe 12 of the ski 10. The bracket 48 preferably includes a pair of legs 50 which extend downwardly but do not contact a top surface of the toe 12 of the ski. The legs space a front edge of the bracket above the top surface of the toe 12 of the ski to form the slot 46 which receives the climbing fabric tensioner 16. The bracket 48 is secured to the toe 12 of the ski 10 by a pair of screw fasteners 52, or the like.

The tensioning cord 30 is preferably threaded through a series of six precisely dimensioned bores 54 in the climbing fabric tensioner 16. The bores 54 are sized to permit the tensioning cord 30 to be inserted therethrough, but to inhibit sliding movement of the fabric tensioner 16 on the tensioning cord 30 when the tensioning cord is under tension. Consequently, the climbing fabric tensioner 16 may be readily adjusted by sliding the tensioning cord 30 through the bores 54. Once the climbing fabric tensioner 16 is correctly positioned on the tensioning cord 30, the climbing fabric tensioner 16 is levered over the toe 12 of the ski 10 and inserted in the slot 46 to securely retain the climbing fabric 20 against the bottom of the ski.

The bracket 48, like the other components described above, is preferably made from a sheet metal stock. An aluminum alloy sheet having a thickness of about 0.0621" (1.58 mm) is preferred. The climbing fabric tensioner 16 is preferably made from an aluminum alloy sheet stock with good resistance to bending. A thickness of about 0.100" (2.54 mm) is preferred. The tensioning cord 30 is preferably a supple braided nylon, or some equivalent cord that is strong and supple.

The tensioning cord 30 is attached to a front end of the outer side 22 of the climbing fabric 20 by a tensioning plate 26 which is preferably riveted to the climbing fabric 20 using rivets 28 (FIG. 4*c*) or the like. The tensioning plate 26 is preferably a tough pliable plastic sheet of polyurethane, or some equivalent, which is about 0.125" (3.17 mm) thick. The tensioning cord 30 is threaded through a pair of bores 29 in the tensioning plate 26.

As explained above, to mount the climbing fabric 20 to a ski, the heel lock 18 is slid forwardly over the heel of the ski so that the U-shaped throat 38 (FIG. 2*b*) engages the boss 36 mounted to a top surface of the heel 14 of the ski 10. Each Z-shaped bracket 32 is then rotated about 40° so that the inturned ends 42 of the Z-shaped bracket 32 clear the opposite sides of the ski. The Z-shaped bracket 32 is then rotated back to its normal position so that the inturned ends 42 extend over the top surface of the ski 10. The front end of the climbing fabric tensioner 16 is then gripped between the thumb and forefinger and the climbing fabric tensioner is levered over the toe 12 of the ski and inserted into the slot 46 between the bracket 48 and the toe of the ski. If the climbing fabric 20 is not under adequate tension, the climbing fabric tensioner 16 is removed from the slot 46 and the cord 30 is drawn through the bores 54 to position the climbing fabric tensioner 16 near the tensioning plate 26 (FIG. 4*c*). The climbing fabric tensioner 16 is then levered again over the toe 12 of the ski and inserted in the slot 46.

As will be appreciated by those skilled in the art, the system in accordance with the invention permits a climbing fabric to be mounted to a ski in a matter of seconds. It is just as quickly removed. When not in use, the climbing fabric 20 including the heel lock 18, the Z-shaped bracket 32 and the climbing fabric tensioner 16 are readily rolled into a very compact bundle which may be inserted in a jacket pocket or the like. The system in accordance with the invention is therefore particularly useful for wilderness mountain skiing where long arduous climbs are followed by extended downhill glides. After a long climb, the climbing fabric is removed and stored in a pocket. The system in accordance with the invention therefore provides an unencumbered ski for extended downhill glides. For short glides or traverses during climbing, the climbing fabric 20 may be left on the skis since the heel lock 18 and the Z-shaped bracket(s) prevent lateral displacement of the climbing fabric 20 from under the ski even during traverses on steep slopes.

Minor modifications of the above-described embodiment will no doubt be apparent to those skilled in the art. The scope of the invention is therefore intended to be limited solely by the scope of the appended claims.

I claim:

1. A system for mounting climbing fabric to a ski, the climbing fabric having a front end and a rear end, an outer side for engaging snow and an underside for contacting the ski, the climbing fabric being shaped to permit the ski to glide in a forward direction but resist movement in a rearward direction when the outer side is placed on a snow covered surface, comprising in combination:

a climbing fabric tensioner attached to the front end of the climbing fabric by a tensioning cord, the climbing fabric tensioner being a flat plate adapted to be retained in a slot formed by a bracket attached to a toe of the ski;

a U-shaped heel lock attached to a rear end of the climbing fabric, the heel lock adapted to engage a boss in a top surface of a heel of the ski to lock the rear end of the climbing fabric to the heel of the ski; and at least one z-shaped bracket attached to the underside of the climbing fabric between the heel lock and the climbing fabric tensioner, the at least one z-shaped bracket having upturned and inturned ends adapted to engage opposite sides of the ski when the climbing fabric is mounted thereto to prevent the climbing fabric from sliding laterally from under the ski.

2. A system for mounting climbing fabric to a ski as claimed in claim 1 wherein the climbing fabric tensioner comprises a metal plate which includes a plurality of bores through which the tensioning cord is threaded.

3. A system for mounting climbing fabric to a ski as claimed in claim 1 wherein the z-shaped bracket is riveted to the climbing fabric.

4. A system for mounting climbing fabric to a ski as claimed in claim 1 wherein an end of the bracket is adapted to be supported above the top surface of the ski by a pair of spaced apart legs so that the slot is adapted to be located between the bracket and the ski for receiving the climbing fabric tensioner.

5. A system for mounting climbing fabric to a ski as claimed in claim 1 wherein the heel lock is substantially U-shaped in side view and is adapted to slide forwardly over the heel of the ski.

6. A system for mounting climbing fabric to a ski as claimed in claim 5 wherein the heel lock has a deep throat in the portion that slides over the top surface of the ski, the throat being adapted to accept the boss when the heel lock is slid forwardly over the heel of the ski.

7. A system for mounting climbing fabric to a ski as claimed in claim 6 wherein the heel lock is riveted to the climbing fabric.

8. A system for mounting climbing fabric to a ski as claimed in claim 1 wherein the tensioning cord is attached to a front end of the climbing fabric by a tensioning plate.

9. A system for mounting climbing fabric to a ski as claimed in claim 8 wherein the tensioning plate is riveted to an outer side of the climbing fabric.

10. A system for mounting climbing fabric to a ski as claimed in claim 9 wherein the tensioning plate includes a pair of spaced-apart bores through which the flexible cord is threaded.

11. A system for mounting climbing fabric to a ski, the climbing fabric having a front end and a rear end, an outer side for engaging snow and an underside for contacting the ski, the climbing fabric being shaped to permit the ski to glide in a forward direction but resist movement in a rearward direction when the outer side is placed on a snow covered surface, comprising in combination:

a climbing fabric tensioner attached to the front end of the climbing fabric by a tensioning cord, the climbing fabric tensioner being a flat plate adapted to be retained in a slot formed by a bracket attached to a top surface of a toe of the ski;

a heel lock attached to a rear end of the climbing fabric, the heel lock being adapted to slidingly engage a heel of the ski and a pin in a top surface of the heel of the ski to lock the rear end of the climbing fabric to the heel of the ski; and at least one z-shaped bracket attached to the underside of the climbing fabric between the heel lock and the climbing fabric tensioner, the at least one z-shaped bracket having upturned and inturned ends adapted to extend inwardly over a top surface of opposite sides of the ski when the climbing fabric is mounted thereto, to prevent the climbing fabric from sliding laterally from under the ski.

12. A system for mounting climbing fabric to a ski as claimed in claim 11, wherein the tensioning cord is attached to the front end of the climbing fabric by a tensioning plate which is riveted to the outer surface of the climbing fabric and includes a pair of bores through which the tensioning cord is threaded.

13. A system for mounting climbing fabric to a ski as claimed in claim 11 wherein the heel lock includes a deep throat adapted to receive the pin in the heel of the ski to prevent lateral displacement of the heel lock on the ski.

14. A system for mounting climbing fabric to a ski as claimed in claim 11 wherein the climbing fabric tensioner is substantially oval in plan view and includes a plurality of bores through which the tensioning cord is threaded.

15. A system for mounting climbing fabric to a ski as claimed in claim 14 wherein the bores are dimensioned to receive the tensioning cord so that the tensioning cord is inhibited from sliding through the bores when the climbing fabric tensioner is secured to the toe of the ski and the tensioning cord is under tension.

* * * * *